US007588208B2

(12) United States Patent
Stitz

(10) Patent No.: US 7,588,208 B2
(45) Date of Patent: Sep. 15, 2009

(54) PROCESS AND DEVICE FOR ACTIVE VIBRATION DAMPING FOR WINDING MACHINES

(75) Inventor: Albert Stitz, Kürten (DE)

(73) Assignee: Voith Patent GmbH, Krefeld (DE)

( * ) Notice: Subject to any disclaimer, the term of this patent is extended or adjusted under 35 U.S.C. 154(b) by 1516 days.

(21) Appl. No.: 10/148,000

(22) Filed: May 20, 2002

(65) Prior Publication Data

US 2002/0185567 A1 Dec. 12, 2002

(30) Foreign Application Priority Data

May 23, 2001 (DE) ..... 101 25 192

(51) Int. Cl.
*B65H 18/08* (2006.01)

(52) U.S. Cl. ..... 242/534; 242/542.2; 242/541.7; 242/547; 242/907

(58) Field of Classification Search ..... 242/534, 242/542.2, 907, 541.7, 547
See application file for complete search history.

(56) References Cited

U.S. PATENT DOCUMENTS

| | | | | |
|---|---|---|---|---|
| 3,902,677 | A * | 9/1975 | Wolf | 242/542 |
| 4,047,676 | A * | 9/1977 | Dahl et al. | 242/541.5 |
| 4,095,755 | A * | 6/1978 | Snygg et al. | 242/541.6 |
| 4,165,843 | A * | 8/1979 | Wedig et al. | 242/413.2 |
| 4,171,106 | A * | 10/1979 | Crouse | 242/534.2 |
| 4,313,577 | A * | 2/1982 | Peters | 242/542.4 |
| 5,431,261 | A | 7/1995 | Olgac | |
| 5,806,783 | A * | 9/1998 | Turunen | 242/530.1 |
| 6,241,178 | B1 * | 6/2001 | Schonmeier et al. | 242/541.5 |

FOREIGN PATENT DOCUMENTS

| | | |
|---|---|---|
| DE | 1245246 | 9/1969 |
| DE | 2018494 | 11/1971 |
| DE | 7121923 | 11/1972 |
| DE | 2128097 | 1/1973 |
| DE | 2318351 | 7/1974 |
| DE | 7305837 | 10/1974 |
| DE | 7313841 | 5/1975 |
| DE | 2709740 | 9/1977 |
| DE | 2615252 | 10/1977 |
| DE | 7609748 | 9/1978 |
| DE | 3243994 | 5/1984 |
| DE | 3836367 | 12/1989 |
| DE | 4007329 | 9/1991 |
| DE | 4201327 | 7/1993 |
| DE | 19629205 | 1/1998 |
| DE | 19716887 | 10/1998 |
| DE | 19818816 | 6/1999 |
| DE | 19851023 | 5/2000 |

(Continued)

OTHER PUBLICATIONS

Patent Abstracts of Japan No. 62196253 A, published Aug. 29, 1987,

*Primary Examiner*—Sang Kim

(57) ABSTRACT

Process and apparatus for damping vibrations in a machine for winding material webs, in which the apparatus includes at least two cylindrical bodies. The process includes positioning the at least two cylindrical bodies to roll on each other to form a nip, such that at least one of imbalance and out-of-roundness of either of the at least two cylindrical bodies form a system capable of vibration. The process further includes actively damping vibrational forces of the vibration system in at least one of the at least two cylindrical bodies by displacing an axis of rotation of the at least one of the at least two cylindrical bodies in accordance with a current one of a plurality of vibrational force measurements made per each rotation of the at least one of at least two cylindrical bodies and with additional energy fed from outside of the vibration system.

22 Claims, 5 Drawing Sheets

FOREIGN PATENT DOCUMENTS

| | | | |
|---|---|---|---|
| DE | 19852257 | | 5/2000 |
| DE | 29522305 | | 8/2001 |
| EP | 0792829 | | 9/1997 |
| JP | 02144358 A | * | 6/1990 |
| WO | 93/15988 | | 8/1993 |
| WO | 93/25461 | | 12/1993 |

* cited by examiner

PROCESS AND DEVICE FOR ACTIVE VIBRATION DAMPING FOR WINDING MACHINES

CROSS-REFERENCE TO RELATED APPLICATIONS

The present application claims priority under 35 U.S.C. § 119 of German Patent Application No. 101 25 192.0 filed May 23, 2001, the disclosure of which is expressly incorporated by reference herein in its entirety.

BACKGROUND OF THE INVENTION

1. Field of the Invention

The invention relates to a process for damping vibrations during the winding of material webs, in particular paper and cardboard webs, in which the process includes at least two bodies, e.g., a winding reel and an adjacent roll, arranged to form a nip, and that, through imbalance or out-of-roundness, the two bodies together form a system capable of vibration.

The invention also relates to a winding machine structured to perform a winding process that includes the at least two bodies arranged to form a nip, such that imbalance or out-of-roundness of at least one of the two bodies creates vibrations in the machine.

2. Discussion of Background Information

Winding machines are known in many different designs and are used to wind a material web to form wound reels. In the production of paper or cardboard webs, winding of finished web several meters wide takes place either at the end of the paper machine or at the end of a downstream coating machine. Such winding machines are known, e.g., from German Patent Application No. DE 40 07 329 A1 and European Patent Application No. EP 0 792 829 A2. The winding machine from German Patent Application No. DE 40 07 329 A1 is equivalent to the construction type of the so-called Pope reel. European Patent Application No. EP 0 792 829 A2 shows a different construction type of a Pope reel in which the winding axis remains stationary during winding, but the press roll is displaced horizontally as the reel grows larger.

In order to produce narrower winding reels with a higher winding quality, the web is divided by several longitudinal slits into individual webs which are wound onto cores usually made of paperboard.

This winding on cores takes place either on so-called support roller type winding machines or on so-called backup roll winding machines. A support roller winding machine in which the webs are wound in an upper gusset (spandrel) between the two support rolls is known from document International Application No. WO 93/25461. Guide heads engage in the outer ends of the outer cores to prevent an axial displacement of the winding reels in the winding bed. International Application No. WO 93/15988 discloses a winding machine that features only one roll, and this winding machine is also referred to as a backup roll winding machine. In the upper area of this backup roll, the winding reels rest offset to one another in an alternating manner with respect to the apex line (crown) of the backup roll. Guide heads engage in the cores of the winding reel on both sides to hold the winding reels on the backup roll, which guide heads are connected to piston cylinder units to reduce the bearing load of the winding reels on the backup roll.

Another prior art, German Patent Application No. DE 32 43 994 A1, describes a support roller type winding machine in which a total of three support rolls are available next to each other in an axially parallel way. This results in a total of two winding beds in which the winding reels are arranged in an alternating manner.

These cited winding machines have in common that at least one roll and at least one winding reel together always form a pressure line. In part, these winding machines also have an additional press roll which provides the winding reels with an additional contact pressure, e.g., from above. Likewise, the cited winding machines have in common that vibrations can occur, e.g., through imbalance of the rolls and above all through the winding reels. The vibrations caused by imbalance are synchronous with the rotational frequencies of the rolls or the winding reels. However, fluctuations, e.g., in the thickness of the material to be wound, lead to circumferential out-of-roundnesses of the surface in the case of the winding reels. This triggers additional vibrations which with support roller type winding machines can lead in extreme cases to the winding reel jumping out of the winding bed.

German Patent Application No. DE 196 29 205 A1 describes a process and a device for winding up a paper web into a wound reel with vibration damping. Here a Pope reel is developed into a system vibrating in phase opposition with the aid of coordinated elastic mass systems, in connection with dampers (shock absorbers) in parallel connection and/or series connection. This system is realized either still with an additional mass able to vibrate or with an infinite additional mass, e.g., in the form of a wall. Although the determination of the horizontal vibration portions is made by movement sensors to coordinate the system, through this coordination, the system can only vibrate in a typical fundamental frequency (which essentially corresponds to the rotational frequency of the winding reel) and in integral multiples of the fundamental frequency. A direct reaction to momentary, a periodic unevennesses of the winding reel, thus to frequency fractions smaller than the rotational frequency, is not possible.

SUMMARY OF THE INVENTION

Therefore, the instant invention provides a process and a winding machine with which vibrations during winding can be reduced or even avoided.

In particular, the instant invention includes that, at least one of the bodies of the vibration system undergoes an active damping regarding vibrational forces, such that, per rotation of the at least one body, a plurality of vibrational force measurements are made. Depending on a current measuring value, an axis of rotation of the at least one body is displaced so as to reduce the vibrational forces. In this regard, displacing the axis of rotation occurs by additional energy fed from outside of the system.

Moreover, the instant invention provides an apparatus that includes displaceable bearings located at ends of an axis of rotation of at least one of the bodies, transducers assigned to these displaceable bearings, and regulating units to provide additional energy to act on the bearings.

According to the invention, vibrational forces (i.e., dynamic forces) occurring in at least one roll or at least one winding reel are measured at a high scan rate (i.e., number of measurements per second) in order to reduce the vibrational forces by a direct shift of the axis of rotation of the vibrating body.

With a "bulge" in the winding reel, compared with its otherwise circular form, the shifting of the axis of rotation means that the axes of rotation of the roll and of the winding reel are temporarily brought further apart for the duration of the "bulge." In the case of a "dent" in the winding reel, a reduction of the distance between the axes of rotation correspondingly occurs. Within the scope of the invention, the axis of rotation of the winding reel or of the roll or both axes of rotation can be displaced at the same time.

The vibration damping according to the invention can also be described in accordance with the following example. One roll and one winding reel are arranged to roll on one another such that the cylindrical circumference of the jacket surface of the roll follows the quasi-cylindrical surface of the winding reel. If a roll were deliberately pressed against a "bump" by a temporary increase in forces, the winding reel would be accelerated away from the "bump" by elasticities of the winding reel and, possibly, also of the roll coat. In this manner, vibrations would arise due to this arrangement.

Moreover, even if a winding reel is circular and concentric, but its center of gravity does not lie on its axis of rotation, imbalance occurs which would cause the winding reel and also the winding machine to vibrate. If, during winding, the center of gravity of the winding reel approaches an imaginary connecting line between its axis of rotation and the nip line with the roll, the roll is subjected to higher bearing forces. The eccentricity and thus the imbalance would further increase due to elasticities of the winding reel and, possibly, also those of the roll coat. A pressing of the roll against the eccentricity is therefore necessary, which involves the axis of rotation of the roll approaching the axis of rotation of the winding reel. This can likewise also be called a shift of the axis of rotation of the roll.

It can also occur that imbalance and/or out-of-roundnesses of a winding reel can impact the roll ends of a displaceable roll to differing extents. Therefore, a roll does not necessarily have to be displaced axially parallel, instead individual reactions can be made at the bearing points with the axis shift.

Additional energy is used for displacing the axes of rotation which is independent of a momentary energy condition of the vibrating system (winding reel and support roll or press roll). Therefore, the additional energy cannot cause the vibrating system to vibrate. If the additional energy is supplied, e.g., by a powerful hydraulic pump, and if this hydraulic pump is additionally operated only in its lower range of capacity, a capacity falling in the upper range of the pump characteristic cannot stimulate vibration system either. The type of vibration damping according to the invention is an active vibration damping.

The instantaneous vibrational forces are proportional to the instantaneous vibrational accelerations. Within the scope of the invention, it is therefore possible to measure not only the vibrational forces for evaluating the vibration, but also the acceleration itself or the associated physical values, such as course and speed. By suitable differentiation and/or calculation either the forces can then be determined or the above-mentioned physical values are used without further processing for the control process of the active vibration damping.

Active vibration damping is also already known from vehicle construction, where noises in a vehicle interior are measured at a very high scan rate in order to effect a noise cancellation by a targeted control of loudspeakers which then, in contrast to the vibration damping according to the invention, vibrate in phase opposition. However, in vehicle construction, in contrast to winding technology, the energies required for active damping account for only a tiny fraction. This becomes even clearer when you realize that according to today's prior art, a finished wound reel on the Pope reel can weigh over 100 tons.

Accordingly, the present invention is directed to a process for damping vibrations in an apparatus for winding for material webs, in which the apparatus includes at least two cylindrical bodies. The process includes positioning the at least two cylindrical bodies to roll on each other to form a nip, such that at least one of imbalance and out-of-roundness of either of the at least two cylindrical bodies form a system capable of vibration. The process further includes actively damping vibrational forces of the vibration system in at least one of the at least two cylindrical bodies by displacing an axis of rotation of the at least one of the at least two cylindrical bodies in accordance with a current one of a plurality of vibrational force measurements made per each rotation of the at least one of at least two cylindrical bodies and with additional energy fed from outside of the vibration system.

In accordance with a feature of the invention, the at least two cylindrical bodies can include a winding reel and an adjacent roll. The adjacent roll may be at least one of a support roll and a press roll.

According to a further feature of the invention, the web to be wound can be at one of a paper and cardboard web.

Further, at least four measured values can be obtained per rotation of the at least one of the two cylinders.

Moreover, before obtaining a new current measured value, the process can include completing the displacing of the axis of rotation resulting from the previous current measured value.

According to another feature of the instant invention, real-time data processing may be utilized in displacing the axis of rotation.

In accordance with the process, the measured values may be processed in a computer program. The computer program can include an algorithm, whereby the process further includes registering a time slope of the measured values as a function of an unwinding of the at least one of the two cylindrical bodies, recognizing a next rotation of the at least one of the two cylindrical bodies by a sequence of the measured values, and obtaining values for the displacing of the axis of rotation from the registering and recognizing. The algorithm can be adaptive regarding parameters of the vibration system, and, further still, the algorithm may be self-adapting.

According to still another feature, a number of measured values may increase with increasing winding reel diameter.

In accordance with a still further feature of the present invention, a number of measured values at a start of winding can be lower than at an end of the winding.

The present invention is directed to an apparatus for damping vibrations in a winding machine that includes at least two cylindrical bodies structured and arranged for rotation about respective axes of rotation, displaceable bearings coupled at ends of the axis of rotation of at least one of the at least two cylindrical bodies, transducers coupled to the displaceable bearings, and regulating units arranged to act on the displaceable bearings.

According to a feature of the invention, the at least two cylindrical bodies may include a winding reel and an adjacent roll. Further, the adjacent roll can include at least one of a support roll and a press roll.

In accordance with another feature of the present invention, the regulating units can be structured and arranged to apply additional energy from outside of the apparatus. In particular, the additional energy can be vertically directed, the additional energy can be horizontally directed, or the additional energy can be directed toward an axis of rotation of an other of the two cylindrical bodies.

Moreover, the regulating unit can include a hydraulic cylinder. Further, the regulating unit may be vertically oriented, the regulating unit may be horizontally oriented, or the regulating unit may be oriented toward an axis of rotation of an other of the at least two cylindrical bodies.

The present invention is directed to a process for damping vibrations in an apparatus for winding for material webs, in which the apparatus includes at least two cylindrical bodies. The process includes positioning the at least two cylindrical bodies to roll on each other to form a nip, whereby at least one of imbalance and out-of-roundness of either of the at least two cylindrical bodies form a system capable of vibration, and actively damping vibrational forces of the vibration system in at least one of the at least two cylindrical bodies.

According to the invention, the active damping can include making a plurality of vibrational force measurements per rotation of the at least one of the at least two cylindrical bodies, and displacing an axis of rotation of the at least one cylindrical body in accordance with a current vibrational force measurement. The displacing can occur through additional energy fed from outside of the vibration system.

The instant invention is directed to an apparatus for damping vibrations in a machine for winding material webs that includes at least two cylindrical bodies arranged for rotation about respective axes of rotation, wherein the at least two cylindrical bodies are arranged to roll on each other, such that vibrational forces arise, and a device for actively damping the vibrational forces in at least one of the at least two cylindrical bodies.

According to a feature of the invention, the device for actively damping can include a measuring device arranged to take a plurality of vibrational force measurements per rotation of the at least one of the two cylindrical bodies, and a displacement device arranged to displace the axis of rotation of the at least one of the at least two cylindrical body in accordance with a current vibrational force measurement. Further, displaceable bearings can be coupled to each end of the at least one of the at least two cylindrical bodies and the displacement device may include a regulation unit coupled to move the displaceable bearings. The displacement device can be structured and arranged to move the displaceable bearings at least one of horizontally and vertically.

In accordance with yet another feature of the present invention, the displacement device can be structured and arranged to move the displaceable bearings in a direction toward a center of an other of the at least two cylindrical bodies.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
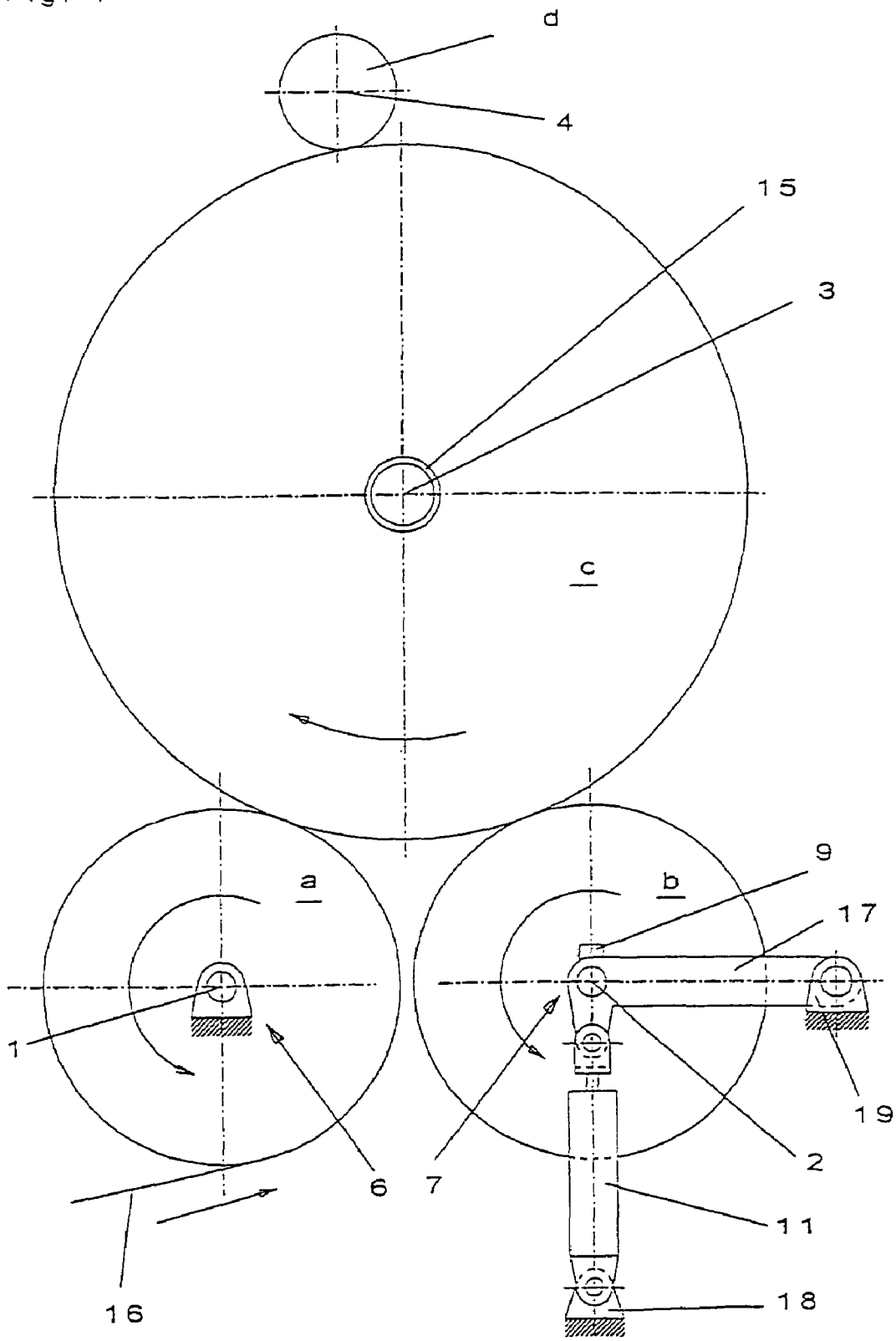
FIG. 1 illustrates a support roller type winding machine with active vibration damping for one support roll with vertical orientation of the vibration damping.

FIG. 1 shows a support roller type winding machine with two support rolls a and b. Winding reel c rests on support rolls a and b. In accordance with the instant invention, winding reel c and/or adjacent rolls, such as the support rolls a and b and press roll d (described below), can be subjected to the active vibration damping, as discussed in more detail below. A material web 16 partially winds around support roll a and is wound on a core 15 in a direction resulting from rotation of support rolls a and b. A press roll d can optionally be available. Support roll b has two bearings 7 (only one of which is shown in the side view depicted in FIG. 1). A transducer 9 is arranged on at least one of bearings 7. Transducer 9 is not subjected to impact by forces, since it is not located in the force flux between winding reel c and support 18. Transducer 9, which can be, e.g., an acceleration pickup, is able to register movements of bearing 7 caused by vibrations in the machine. Bearing 7 is essentially kept in its horizontal position by a brace 17 and a support 19. A regulating unit 11, preferably formed by a hydraulic cylinder, is arranged between bearing 7 and support 18. Connections of the hydraulic cylinder are not illustrated for reasons of clarity, but it is understood that connection of such cylinders is fully within the abilities of those ordinarily skilled in the in art. As an alternative, regulating units 11 can be formed by linear motors. If transducer 9 supplies a signal of a "bump" in winding reel c, evaluation electronics (not shown) can effect a vertical regulating distance for bearing 7 depending on the signal of transducer 9, such that an axially parallel shift of the axis of rotation 2 of support roll b occurs as a result of the regulating distance.

With a support roller type winding machine in which a winding reel has contact simultaneously with two rolls, as depicted in FIG. 1, vibration damping is particularly difficult. That is because, not only do vibrations occur at a nip between the support roll a and winding reel c, but vibrations are occurring at the same time at the second nip between support roll b and winding reel c. Therefore, it is apparent that interactions occur between at least the three bodies (i.e., support rolls a and b and winding reel c).

The necessary axially parallel movements of support roll b are calculated from the bearing forces by a suitable mathematical model. In this way the problems of the interactions in particular can be largely solved.

Figure 2:
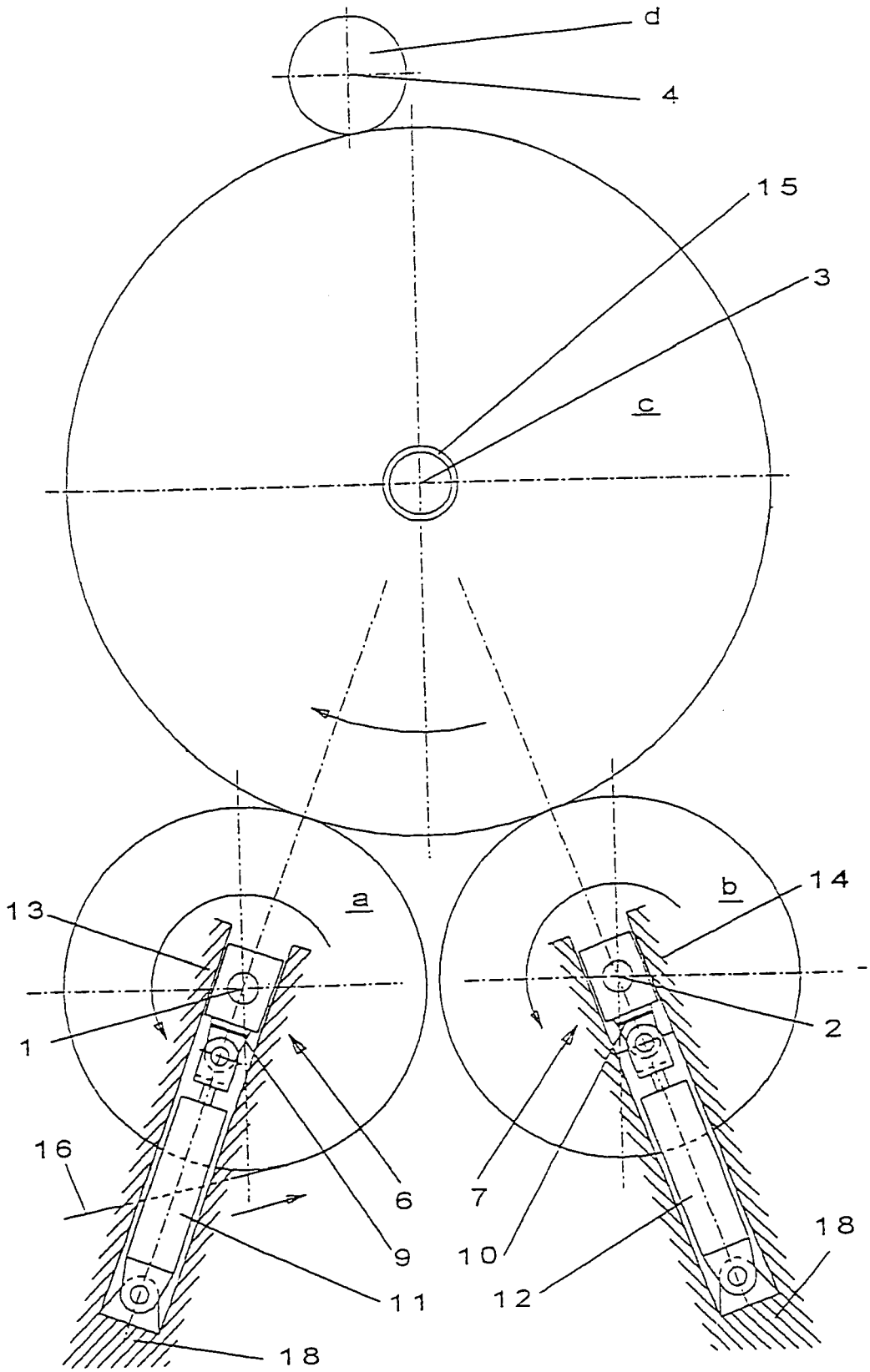
FIG. 2 illustrates a support roller type winding machine with active vibration damping for both support rolls with centered orientation of the vibration damping.

With the support roller type winding machine from FIG. 1, only support roll b has active vibration damping. As a result, vibrational forces still remain which occur due to the rolling of winding reel c on support roll a or because of the rolling of press roll d on winding reel c. Accordingly, in a further development of the instant invention, as depicted in FIG. 2, support roll a is also provided with active vibration damping. Accordingly, regulating units 11 and 12 are essentially orientated to the center of winding reel c and transducers 9 and 10 are arranged between bearings 6 and 7 and regulating units 11 and 12. Furthermore, bearings 6, 7 are arranged to slide in guide devices 13 and 14. In accordance with this arrangement, it is apparent that braces 17 and supports 19, as utilized in the embodiment depicted in FIG. 1, are not necessary. Due to the essentially centered orientation of regulating units 11 and 12, there are only slight forces on the guide surfaces of guide devices 13 and 14. This means that constructive resources for adjusting the vertical and horizontal force components are only minor.

Because a total of two support rolls are displaceable (i.e., with their axes of rotation in an axially parallel manner) and each axis ultimately features two bearings, a complex vibration system develops due to variety of interactions between bodies a, b, c, and d. In order to take these facts into account, it is advisable to process the measuring signals in a computer program. Today's computing powers render possible a real-time data processing of more than about 100 Hz scan rate. By way of example, such a computer program can include an algorithm which registers a time slope of measured values as a function of an unwinding of the body, such that the algorithm recognizes the next rotation of the rotating body by a sequence of the measured values. In this way, values for displacing the axis of rotation can be obtained from its data processing more quickly.

Figure 3:
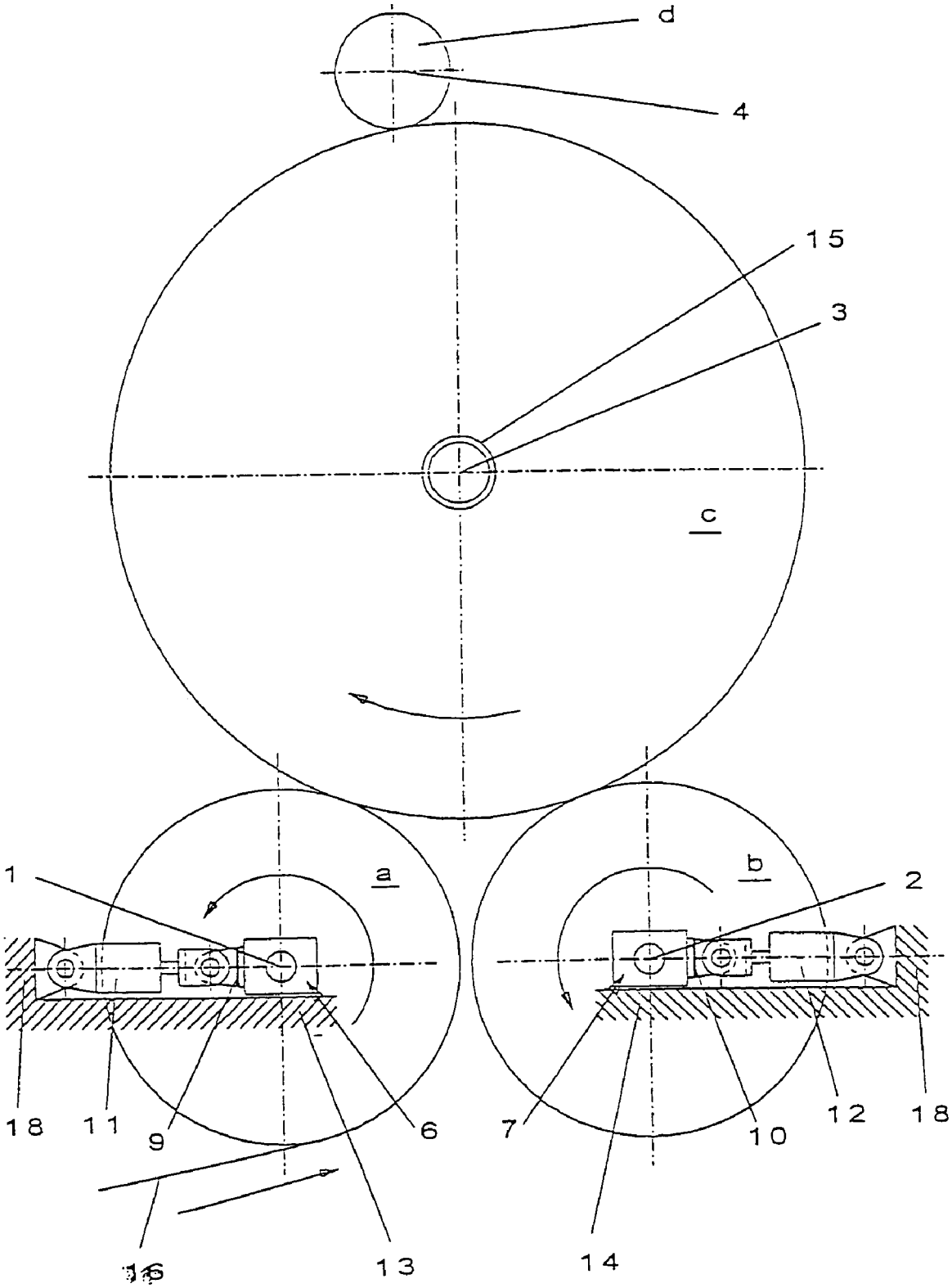
FIG. 3 illustrates a support roller type winding machine with active vibration damping for both support rolls with horizontal orientation of the vibration damping.

FIG. 3 illustrates another arrangement for regulating units 11 and 12 in a support roller type winding machine. Here regulating units 11 and 12 are horizontally oriented. Guide devices 13 and 14 are embodied or formed as supports on only one side due to the weight of winding reel c. As regulating units 11 and 12 have a horizontal orientation, it is possible to react more sensitively, because with a large regulating distance the horizontal component renders possible small vertical components.

Because in a support roller type winding machine only the outer ends of the cores 15 of outer winding reel c respectively are accessible to guide heads, in this case guide heads are only present there. Therefore, no actuating force can act on winding roll c with this type of winding machine, instead the regulating unit can always act on only one of the support rolls.

Figure 4:
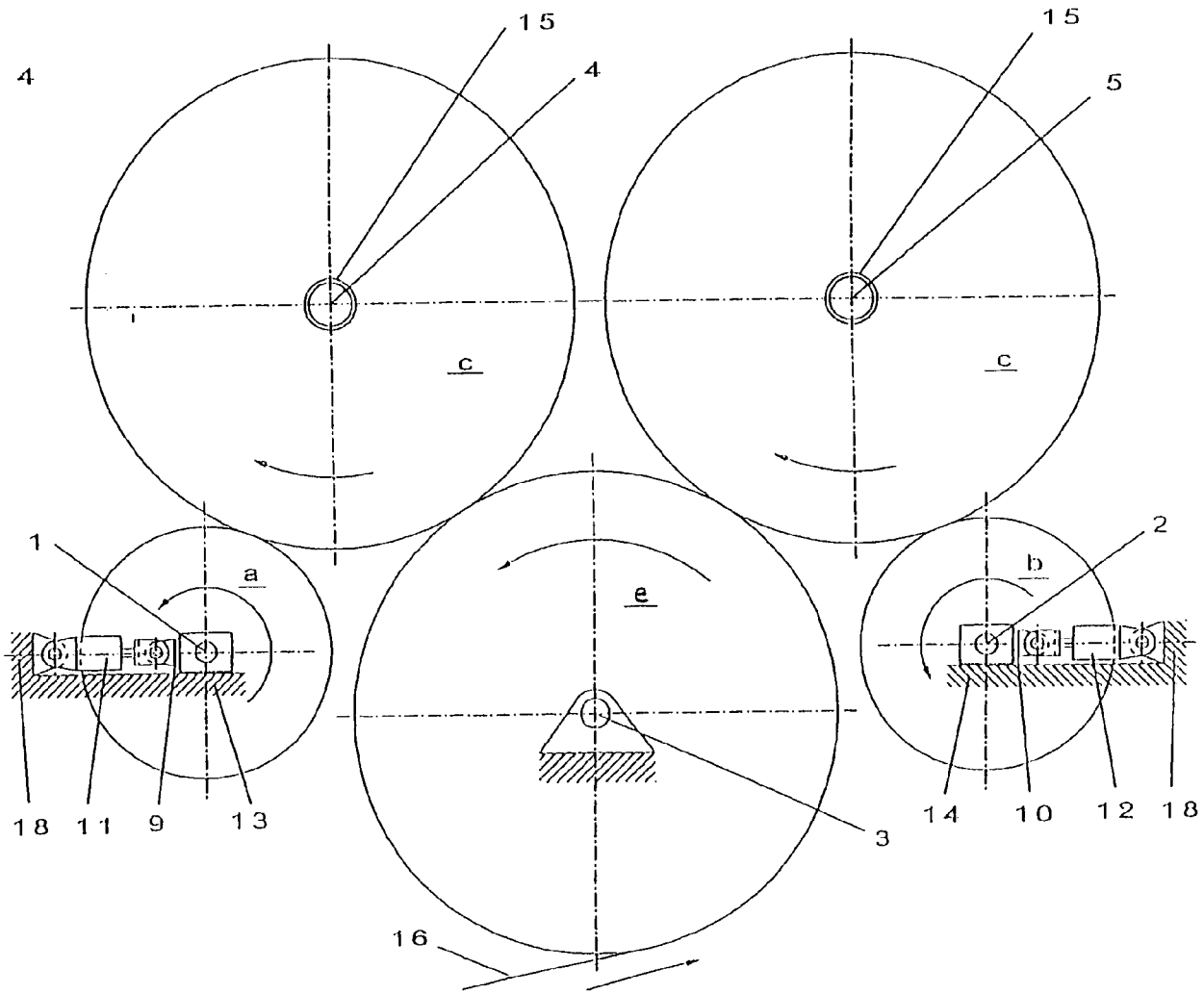
FIG. 4 illustrates a support roller type winding machine with three rolls and with active vibration damping for two support rolls with horizontal orientation of the vibration damping.

FIG. 4 shows a three-roll winding machine. Here winding reels c are arranged offset to one another in an alternating manner with respect to the apex (crown) line of roll e and perpendicular to the drawing plane. Consequently guide heads on both sides of winding reels c can engage cores 15. The principle of the vertical orientation of regulating units 11 and 12 has been implemented here, however, it is noted that this arrangement is for the purpose of illustration and it is understood that any of the disclosed regulating unit arrangements can be utilized. Support roll d is not subjected to any active vibration damping in this exemplary embodiment.

Because the individual winding reels c can be provided with guide heads, it is further understood that, alternatively or additionally, active vibration damping can act on each individual winding reel in accordance with features of the instant invention.

Figure 5:
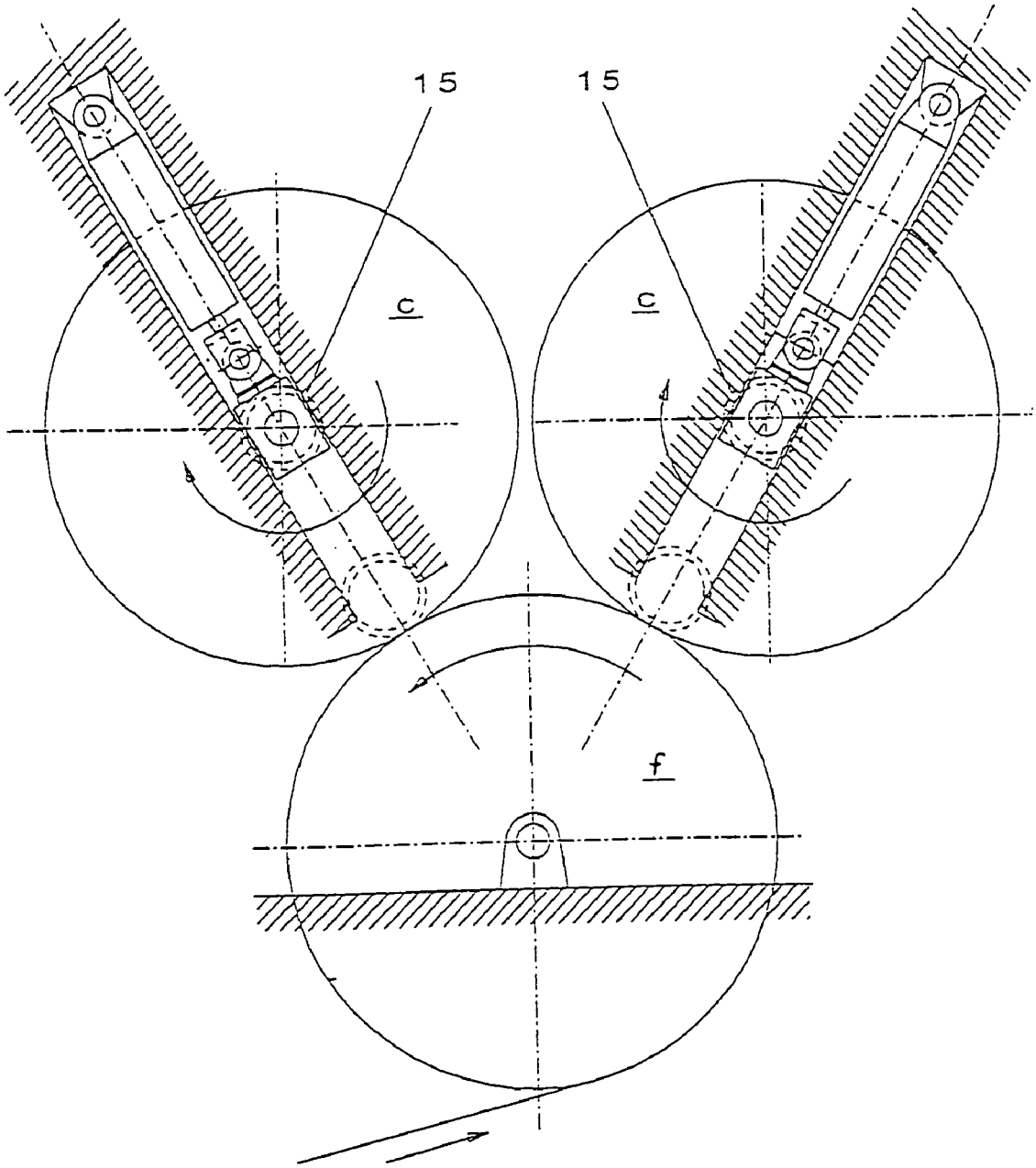
FIG. 5 illustrates a backup roll winding machine with only one roll and with active vibration damping for the winding reel with centered orientation of the vibration damping.

FIG. 5 shows guide heads acting on winding reels c in connection with the active vibration damping according to the present invention. The double circles adjacent support roll f (marked with a broken line) show cores 15 in their position at the start of a winding process. Winding reels c are arranged offset to one another on support roll f in an alternating manner with respect to its apex line and perpendicular to the drawing plane. Therefore, the ends of cores 15 of each winding reel c are accessible for guide heads. Depending on the desired winding tightness, winding reels c are lifted by the regulating units such that the full weight of winding reel c is not brought to bear on support roll f. The contact pressure of winding reel c on support roll f can thus be made smaller than the normal force of the specific weight of the winding reel. With the type of winding machine shown here, the mechanism for lifting winding reel c is combined with the active vibration damping. However, it goes without saying that an additional contact pressure could also be applied by the guide heads.

If either only the axis of rotation of a roll or only that of a winding reel is displaced in the solutions described, torque occurs on the machine frame and on the base. However, if in the scope of the active vibration damping the axes of the support roll and of the winding reel are displaced simultaneously and if the respective displacement paths of the axes of rotation are selected to be inversely proportional to the masses of the corresponding bodies, according to the theorem of momentum, no forces result on the base. If the impacts of the winding reel on a support roll are inelastic or partially elastic, the corresponding modifications of the theorem of momentum apply.

Accordingly, it should also be stressed that active vibration damping can be used not only for support roller or backup roll winding machines, i.e., for material webs 16 divided lengthwise, but also for Pope reel winding machines and its further developments. Here an active vibration damping can act both on the bearings of the press roll (reeling drum) and on the bearings of the winding axis. Furthermore, the present invention can also be used for rewinding machines and also in unwinding stations for coating machines.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for damping vibrations in an apparatus for winding for material webs, the apparatus including at least two cylindrical bodies, said process comprising:

positioning the at least two cylindrical bodies to roll on each other to form a nip, whereby at least one of imbalance and out-of-roundness of either of the at least two cylindrical bodies form a system capable of vibration; and actively damping vibrational forces of the vibration system in at least one of the at least two cylindrical bodies through a displacing of an axis of rotation of the at least one of the at least two cylindrical bodies, in which the displacing results from additional energy fed from outside of the vibration system in response to a current one of a plurality of vibrational force measurements made per each rotation of the at least one of the at least two cylindrical bodies.

2. The process in accordance with claim 1, wherein the at least two cylindrical bodies comprise a winding reel and an adjacent roll.

3. The process in accordance with claim 2, wherein the adjacent roll comprises at least one of a support roll and a press roll.

4. The process in accordance with claim 1, wherein the web to be wound is one of a paper and cardboard web.

5. The process in accordance with claim 1, wherein the plurality of vibrational force measurements made per each rotation of the at least one of the at least two cylindrical bodies comprises at least four measured values obtained per rotation of the at least one of the two cylinders.

6. The process in accordance with claim 1, wherein, before obtaining a new current measured value, the process includes completing the displacing of the axis of rotation resulting from the previous current measured value.

7. The process in accordance with claim 1, wherein real-time data processing is utilized in displacing the axis of rotation.

8. The process in accordance with claim 1, wherein the measured values are processed in a computer program.

9. The process in accordance with claim 8, wherein the computer program includes an algorithm, whereby the process further includes:

registering a time slope of the measured values as a function of an unwinding of the at least one of the two cylindrical bodies, recognizing a next rotation of the at least one of the two cylindrical bodies by a sequence of the measured values; and obtaining values for the displacing of the axis of rotation from the registering and recognizing.

10. The process in accordance with claim 9, wherein the algorithm is adaptive regarding parameters of the vibration system.

11. The process in accordance with claim 10, wherein the algorithm is self-adapting.

12. The process in accordance with claim 1, wherein the plurality of vibrational force measurements made per each rotation of the at least one of the at least two cylindrical bodies comprises a number of measured values that increases with increasing winding reel diameter.

13. The process in accordance with claim 1, wherein the plurality of vibrational force measurements made per each rotation of the at least one of the at least two cylindrical bodies comprises a number of measured values, in which the number of measured values at a start of winding is lower than the number of measured values at an end of the winding.

14. An apparatus for damping vibrations in a winding machine, comprising:

at least two cylindrical bodies being structured and arranged for rotation about respective axes of rotation;

displaceable bearings being coupled at ends of said axis of rotation of at least one of said at least two cylindrical bodies;

transducers being coupled to said displaceable bearings;

regulating units arranged to act on said displaceable bearings; and said regulating units being coupled to said transducers to shift said displaceable bearings, and thereby said axis of rotation, in response to a current one of a plurality of vibrational force measurements made per each rotation of said at least one of said at least two cylindrical bodies by said transducers, wherein said regulating units are structured and arranged to apply additional energy from outside of said apparatus and the additional energy is horizontally directed.

15. An apparatus for damping vibrations in a winding machine, comprising:

at least two cylindrical bodies being structured and arranged for rotation about respective axes of rotation;

displaceable bearings being coupled at ends of said axis of rotation of at least one of said at least two cylindrical bodies;

transducers being coupled to said displaceable bearings;

regulating units arranged to act on said displaceable bearings; and said regulating units being coupled to said transducers to shift said displaceable bearings, and thereby said axis of rotation, in response to a current one of a plurality of vibrational force measurements made per each rotation of said at least one of said at least two cylindrical bodies by said transducers, wherein said regulating unit comprises a hydraulic cylinder, and said regulating unit is horizontally oriented.

16. A process for damping vibrations in an apparatus for winding for material webs, the apparatus including at least two cylindrical bodies, said process comprising:

positioning the at least two cylindrical bodies to roll on each other to form a nip, whereby at least one of imbalance and out-of-roundness of either of the at least two cylindrical bodies form a system capable of vibration;

shifting a rotational axis of at least one of the at least two cylindrical bodies in response to measurements of the at least one of imbalance and out-of-roundness in order to actively damping vibrational forces of the vibration system in the at least one of the at least two cylindrical bodies.

17. The process in accordance with claim 16, wherein the active damping comprises:

making a plurality of vibrational force measurements per rotation of the at least one of the at least two cylindrical bodies;

the measurement of the at least one of imbalance and out-of-roundness comprises a current vibrational force measurement, wherein the shifting occurs through additional energy fed from outside of the vibration system.

18. An apparatus for damping vibrations in a machine for winding material webs comprising:

at least two cylindrical bodies arranged for rotation about respective axes of rotation, wherein said at least two cylindrical bodies are arranged to roll on each other, whereby vibrational forces arise;

a device for actively damping the vibrational forces in at least one of said at least two cylindrical bodies, which includes regulators applying energy independent of a momentary energy condition of the vibrating system.

19. The apparatus in accordance with claim 18, wherein said device for actively damping comprises:

a measuring device arranged to take a plurality of vibrational force measurements per rotation of the at least one of the two cylindrical bodies; and a displacement device arranged to displace the axis of rotation of said at least one of said at least two cylindrical body in accordance with a current vibrational force measurement.

20. The apparatus in accordance with claim 19, wherein displaceable bearings are coupled to each end of said at least one of said at least two cylindrical bodies and said displacement device comprises a regulation unit coupled to move said displaceable bearings.

21. The apparatus in accordance with claim 20, wherein said displacement device is structured and arranged to move said displaceable bearings at least one of horizontally and vertically.

22. The apparatus in accordance with claim 18, wherein said displacement device is structured and arranged to move the displaceable bearings in a direction toward a center of an other of said at least two cylindrical bodies.

* * * * *